US007914067B2

(12) United States Patent
Lee

(10) Patent No.: US 7,914,067 B2
(45) Date of Patent: Mar. 29, 2011

(54) EXCAVATOR MOUNTED WITH TANKS HAVING SIDE DOORS

(75) Inventor: Taek Woo Lee, Gimhae-si (KR)

(73) Assignee: Volvo Construction Equipment Holding Sweden AB, Eskilstuna (SE)

( * ) Notice: Subject to any disclaimer, the term of this patent is extended or adjusted under 35 U.S.C. 154(b) by 100 days.

(21) Appl. No.: 12/270,023

(22) Filed: Nov. 13, 2008

(65) Prior Publication Data

US 2009/0133297 A1 May 28, 2009

(30) Foreign Application Priority Data

Nov. 28, 2007 (KR) ..... 10-2007-0121985

(51) Int. Cl.
*B60R 21/13* (2006.01)

(52) U.S. Cl. ..... 296/190.03; 180/89.12

(58) Field of Classification Search ..... 37/403–407, 37/466, 443; 414/719, 690, 694, 680; 180/89.12, 180/89.1, 69.2; 280/755, 757, 758, 759, 280/760; 296/190, 190.03, 190.08, 200
See application file for complete search history.

(56) References Cited

U.S. PATENT DOCUMENTS

| | | | | |
|---|---|---|---|---|
| 3,860,083 | A * | 1/1975 | Yancey | 180/69.2 |
| 5,033,567 | A * | 7/1991 | Washburn et al. | 180/89.12 |
| 5,535,775 | A * | 7/1996 | Blaine | 137/355.17 |
| 6,296,436 | B1 * | 10/2001 | Ramun | 414/719 |
| 6,769,732 | B2 * | 8/2004 | Sakyo | 296/190.03 |

FOREIGN PATENT DOCUMENTS

| | | |
|---|---|---|
| JP | 10-292429 | 11/1998 |
| JP | 2001-288777 | 10/2001 |
| JP | 2007-285003 | 11/2007 |
| WO | 02/070827 | 9/2002 |

OTHER PUBLICATIONS

Patent Abstract of Japan 2001-288777 dated Oct. 19, 2001.
Patent Abstract of Japan 2007-285003 dated Nov. 1, 2007.
Patent Abstract of Japan 10-292429 dated Nov. 4, 1998.

* cited by examiner

*Primary Examiner* — Robert E Pezzuto
(74) *Attorney, Agent, or Firm* — Ladas & Parry LLP

(57) ABSTRACT

An excavator mounted with tanks having side doors. Bend-formed side doors are mounted on outer sides of a hydraulic fluid tank and a fuel tank that are welded structures mounted on an upper frame of the excavator, have the same curved surfaces as an external shape of the equipment, so that no precise tank manufacturing work is required and welded portions of the tanks are prevented from being exposed to an outside.

2 Claims, 5 Drawing Sheets

EXCAVATOR MOUNTED WITH TANKS HAVING SIDE DOORS

CROSS-REFERENCE TO RELATED APPLICATION

This application is based on and claims priority from Korean Patent Application No. 10-2007-0121985, filed on Nov. 28, 2007 in the Korean Intellectual Property Office, the disclosure of which is incorporated herein in its entirety by reference.

BACKGROUND OF THE INVENTION

1. Field of the Invention

The present invention relates to an excavator mounted with tanks having side doors, in which bend-formed side doors are mounted on outer sides of a hydraulic fluid tank and a fuel tank (hereinafter referred to as "tanks") that are welded structures mounted on an upper frame of the excavator, so that the side doors form outer side surfaces of the tanks.

More particularly, the present invention relates to an excavator mounted with tanks having side doors, in which bend-formed side doors mounted on outer sides of tanks that are welded structures have the same curved surfaces as an external shape of the equipment, so that no precise tank manufacturing work is required and welded portions of the tanks are prevented from being exposed to an outside.

2. Description of the Prior Art

As illustrated in FIG. 1, a conventional excavator mounted with tanks includes a lower driving structure 1; an upper frame 2 mounted on the lower driving structure 1 to be swiveled; a cap 3 and an engine room 4 mounted in front and in the rear of the upper frame 2, respectively; working devices 11 fixed to the upper frame 2, and composed of a boom 5, an arm 6, and a bucket 7 driven by hydraulic cylinders 8, 9, and 10, respectively; a counter weight 12 mounted in the rear of the upper frame 2 to keep the balance of the equipment during working; and tanks (i.e. a hydraulic fluid tank 13 and a fuel tank 14) mounted on the upper frame 2 in front of the engine room 4.

Each of the tanks is composed of an outer structure a formed to have the same outer side surface as a side door 4*a* of the engine room 4, and an inner structure b fixed to the outer structure a by welding and mounted on the upper frame 2 by a lower mounting part c formed on a bottom surface.

According to the conventional excavator mounted with tanks, if the outer structure a is formed to have the same curved surface as the external shape of the equipment, a mold for forming the outer structure a is required, and this causes the manufacturing cost of the equipment to increase.

Also, in the case of manufacturing the inner structure b of the tank by welding, welded portions may be deformed or the tank may be potbellied after the tank is manufactured, and this causes the external appearance of the equipment to be degraded. Also, if the measure of the lower mounting part becomes wrong when the box type tank manufactured by welding is mounted on the upper frame 2, the tank becomes unbalanced from neighboring parts to degrade the external appearance of the equipment.

SUMMARY OF THE INVENTION

Accordingly, the present invention has been made to solve the above-mentioned problems occurring in the prior art, and an object of the present invention is to provide an excavator mounted with tanks having side doors, in which bend-formed side doors mounted on outer sides of tanks have the same curved surfaces as an external shape of the equipment, so that a mold for precisely manufacturing the tanks is not required, and thus the manufacture of the tanks is facilitated with the manufacturing cost thereof reduced.

Another object of the present invention is to provide an excavator mounted with tanks having side doors, in which, in the case of mounting tanks that are welded structures, on an upper frame, deformed welded portions of the tanks, potbellied side parts of the tanks, and lower mount portions formed on bottom surfaces of the tanks can be hidden by the side doors and thus the external appearance of the equipment can be prevented from being deteriorated.

In order to accomplish these objects, there is provided an excavator mounted with tanks having side doors, according to an embodiment of the present invention, which includes a lower driving structure; an upper frame mounted on the lower driving structure to be swiveled; a cap and an engine room mounted in front and in the rear of the upper frame, respectively; working devices fixed to the upper frame, and composed of a boom, an arm, and a bucket driven by hydraulic cylinders, respectively; a counter weight mounted in the rear of the upper frame to keep the balance of the equipment during working; a hydraulic fluid tank and a fuel tank mounted on the upper frame in front of the engine room; and side doors hingedly fixed to outer sides of the hydraulic fluid tank and the fuel tank, respectively, to form outer side surfaces of the hydraulic fluid tank and the fuel tank.

The excavator according to an embodiment of the present invention may further include storage parts corresponding to spaces between the outer side surfaces of the hydraulic fluid tank and the fuel tank and inner side surfaces of the side doors, respectively, to keep service components of the excavator in custody.

In another aspect of the present invention, there is provided an excavator mounted with tanks having side doors, according to an embodiment of the present invention, which includes a lower driving structure; an upper frame mounted on the lower driving structure to be swiveled; a cap and an engine room mounted in front and in the rear of the upper frame, respectively; working devices fixed to the upper frame, and composed of a boom, an arm, and a bucket driven by hydraulic cylinders, respectively; a counter weight mounted in the rear of the upper frame to keep the balance of the equipment during working; a hydraulic fluid tank and a fuel tank mounted on the upper frame in front of the engine room; a side door hingedly fixed to an outer side of the fuel tank to form an outer side surface of the fuel tank; and a side door for the engine room hingedly fixed to an outer side of a cowl frame, and extending to a boundary part between the hydraulic fluid tank and the fuel tank to form outer side surfaces of the engine room and the hydraulic fluid tank.

The excavator according to another embodiment of the present invention may further include storage parts corresponding to a space between the outer side surface of the fuel tank and an inner side surface of the side door and a space between the outer side surface of the hydraulic fluid tank and the inner side surface of the side door for the engine room, respectively, to keep service components of the excavator in custody.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENTS

Hereinafter, preferred embodiments of the present invention will be described with reference to the accompanying drawings. The matters defined in the description, such as the detailed construction and elements, are nothing but specific details provided to assist those of ordinary skill in the art in a comprehensive understanding of the invention, and thus the present invention is not limited thereto.

Figure 1:
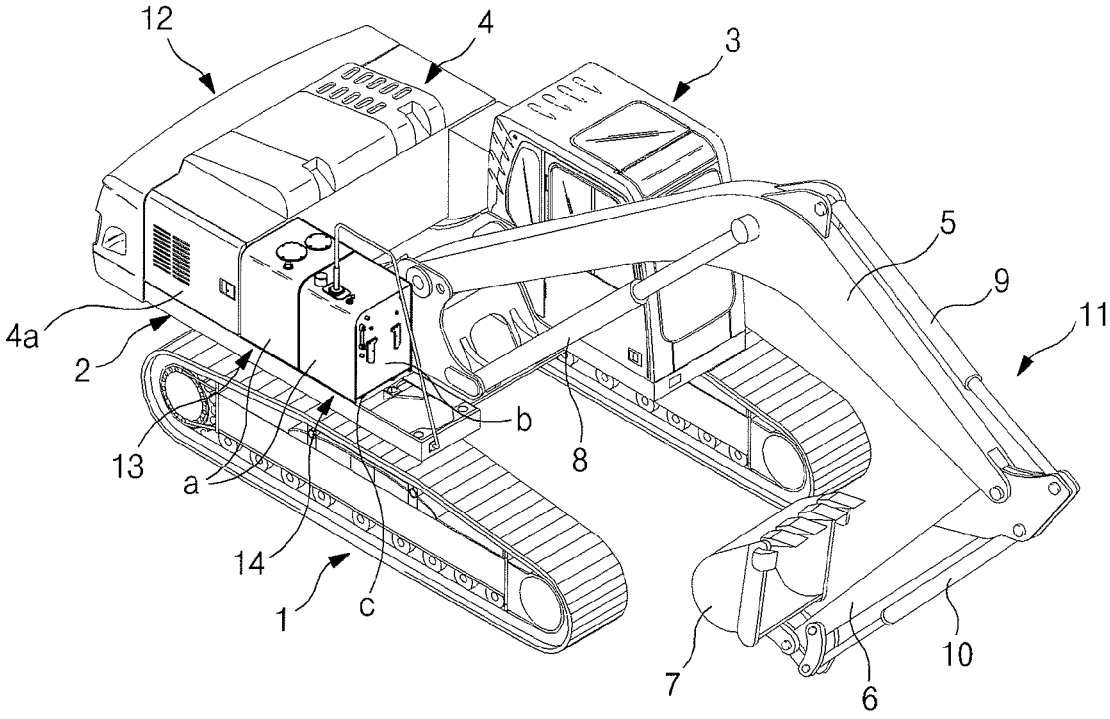
Fig. 1 Prior Art
FIG. 1 is a schematic view illustrating a conventional excavator mounted with tanks.
Figure 2:
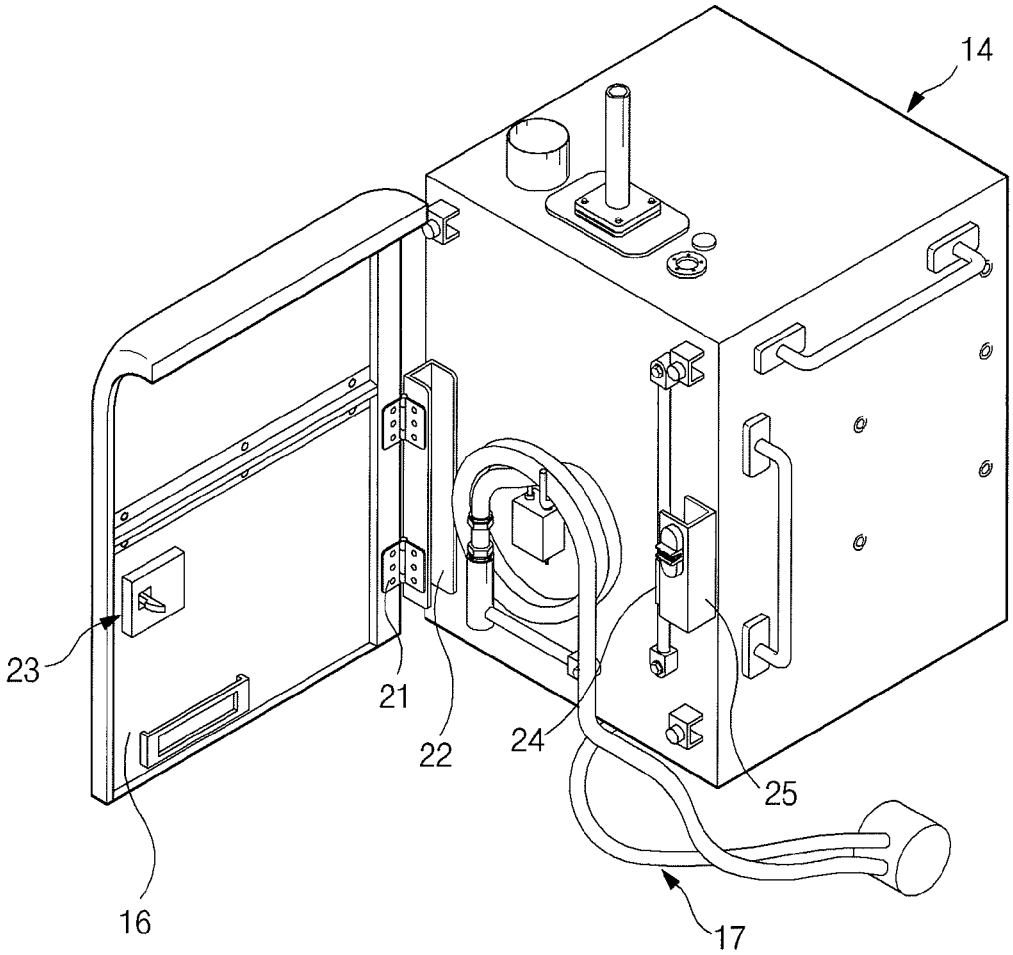
FIG. 2 is a schematic view illustrating a tank having a side door and mounted on an excavator according to an embodiment of the present invention.
Figure 3:
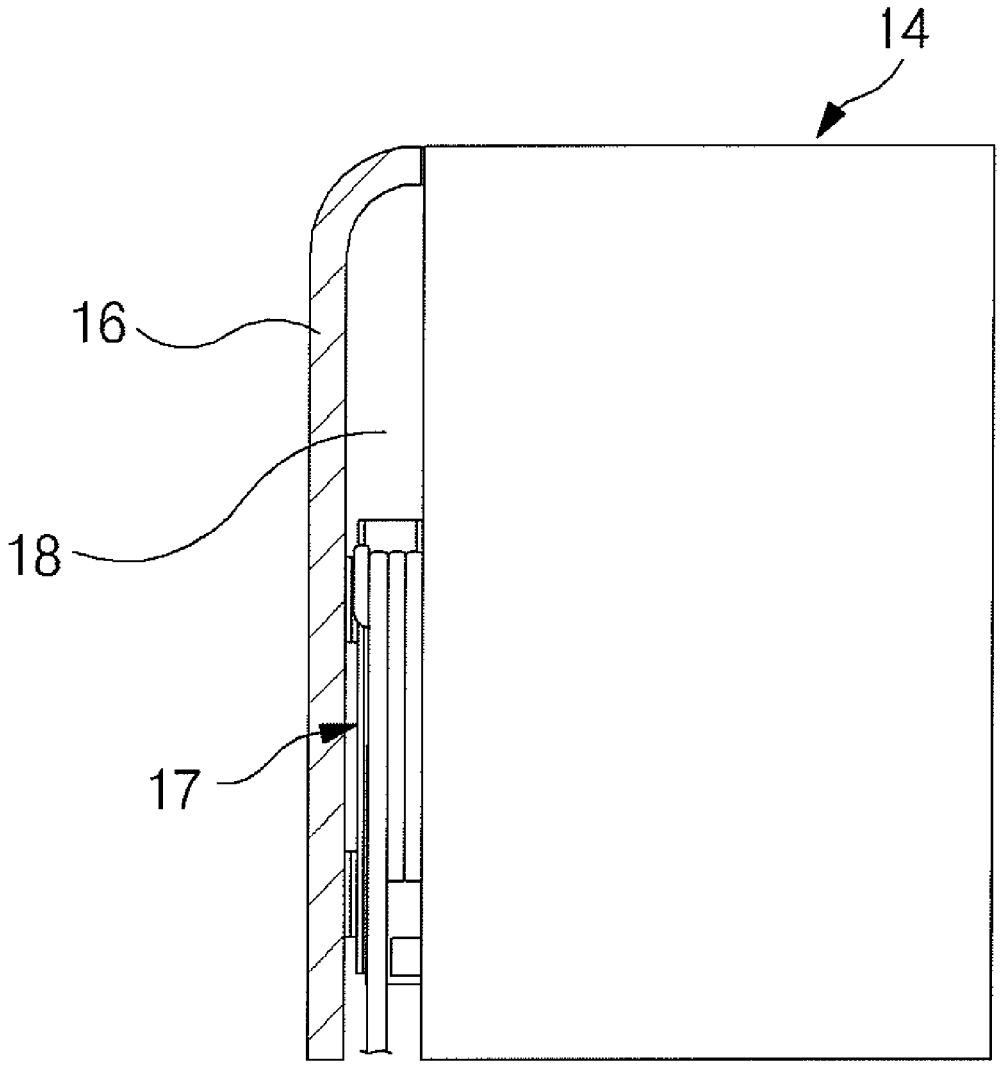
FIG. 3 is a view explaining forming of a storage part between a side door and a tank mounted on an excavator according to an embodiment of the present invention.
Figure 4:
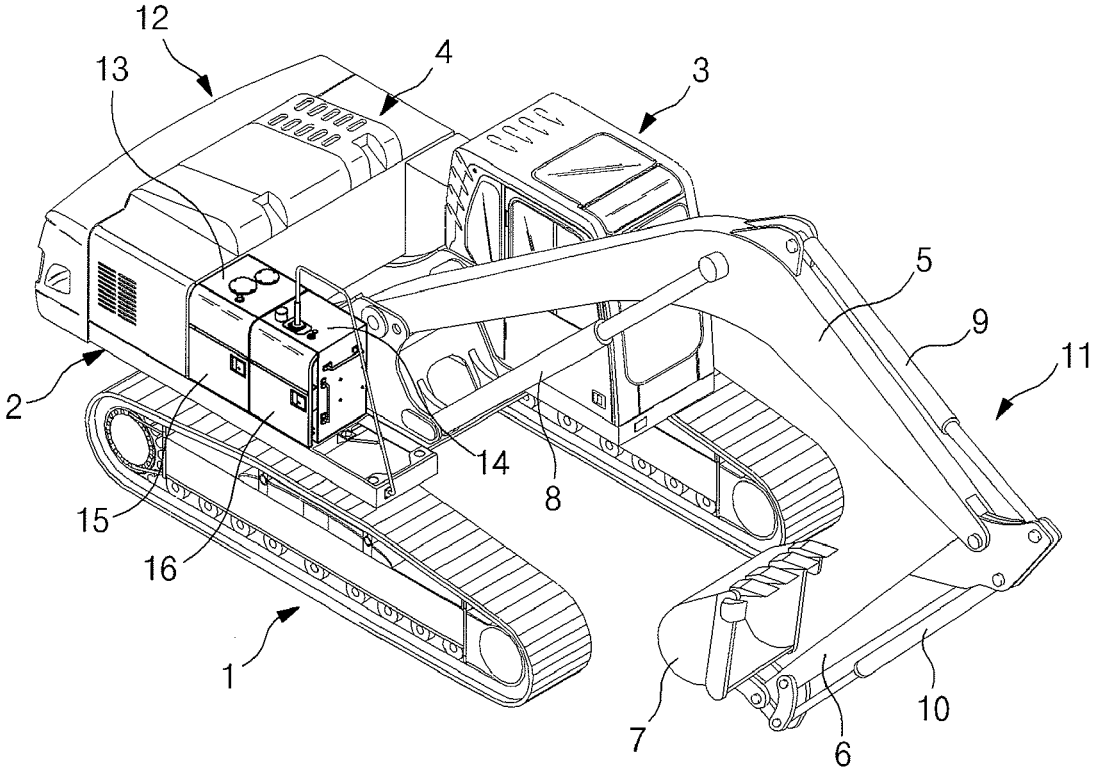
FIG. 4 is a view illustrating the use state of an excavator mounted with tanks having side doors according to an embodiment of the present invention.

As illustrated in FIGS. 2 to 4, an excavator mounted with tanks having side doors according to an embodiment of the present invention includes according to an embodiment of the present invention includes a lower driving structure 1; an upper frame 2 mounted on the lower driving structure 1 to be swiveled; a cap 3 and an engine room 4 mounted in front and in the rear of the upper frame 2, respectively; working devices 11 fixed to the upper frame 2, and composed of a boom 5, an arm 6, and a bucket 7 driven by hydraulic cylinders 8, 9, and 10, respectively; a counter weight 12 mounted in the rear of the upper frame 2 to keep the balance of the equipment during working; a hydraulic fluid tank 13 and a fuel tank 14 mounted on the upper frame 2 in front of the engine room 4; and side doors 15 and 16 being bend-formed, and hingedly fixed to outer sides of the hydraulic fluid tank 13 and the fuel tank 14, respectively, to form outer side surfaces of the hydraulic fluid tank 13 and the fuel tank 14.

The excavator according to an embodiment of the present invention further includes storage parts 18 corresponding to spaces between the outer side surfaces of the hydraulic fluid tank 13 and the fuel tank 14 and inner side surfaces of the side doors 15 and 16, respectively, to keep service components of the excavator (e.g. a fuel pump for feeding fuel) in custody.

In the drawings, the reference numeral "22" denotes a bracket fixed by welding to the outer side surface of the tank, and having a hinge 21 fixed thereto, and "25" denotes a bracket on which a latch corresponding to a catch 23 mounted on the inner side surface of the side door 16 is mounted.

Hereinafter, an excavator mounted with tanks having side doors according to an embodiment of the present invention will be described in detail with reference to the accompanying drawings.

As illustrated in FIGS. 2 to 4, in the excavator according to an embodiment of the present invention, it is not required to use a mold for precisely forming a tank that is a welded structure so that the tank has the same curved surface as an external shape of the equipment (e.g. the equipment may have a curved external shape).

That is, the tanks are manufactured by a welding process, the side doors 15 and 16 are bend-formed to have the same curved surface as the external shape of the equipment, and then the side doors 15 and 16 are hingedly fixed to the outer side surfaces of the tanks by hinges 21, respectively. Accordingly, when the tanks are mounted on the upper frame 2, the side doors 15 and 16 form the outer side surfaces of the hydraulic fluid tank 13 and the fuel tank 14.

Accordingly, deformed welded portions of the tanks that are welded structures mounted on the upper frame 2, potbellied side parts of the tanks, and lower mount portions formed on bottom surfaces of the tanks can be hidden by the side doors 15 or 16 that form the outer side surfaces of the hydraulic tank 13 and the fuel tank 14, and thus the external appearance of the equipment can be prevented from being deteriorated.

As illustrated in FIG. 3, the storage part 18 formed between the outer side surface of the fuel tank 14 and the side door 16 can be usefully utilized. Specifically, in the case of supplementing fuel during working on the work spot, a locking means (composed of a catch 23 and a latch 24) of the side door 16 is released, and then the service components such as a fuel pump for feeding fuel, which is kept in custody in the storage part 18, is taken out to be used.

In this case, since the manipulation of the locking means of the side door 16 and the use of the service components are well known in the art, the detailed description thereof will be omitted.

Figure 5:
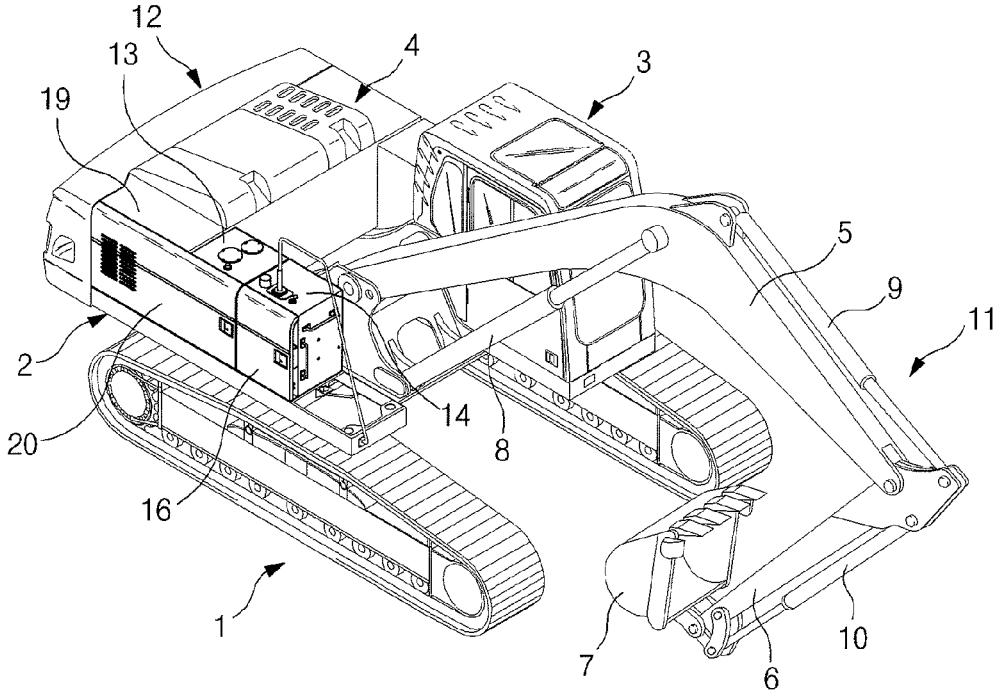
FIG. 5 is a schematic view illustrating an excavator mounted with tanks having side doors according to another embodiment of the present invention.

As illustrated in FIG. 5, an excavator mounted with tanks having side doors according to another embodiment of the present invention includes a lower driving structure 1; an upper frame 2 mounted on the lower driving structure 1 to be swiveled; a cap 3 and an engine room 4 mounted in front and in the rear of the upper frame 2, respectively; working devices 11 fixed to the upper frame 2, and composed of a boom 5, an arm 6, and a bucket 7 driven by hydraulic cylinders 8, 9, and 10, respectively; a counter weight 12 mounted in the rear of the upper frame 2 to keep the balance of the equipment during working; a hydraulic fluid tank 13 and a fuel tank 14 mounted on the upper frame in front of the engine room 4; a side door 16 hingedly fixed to an outer side of the fuel tank 14 to form an outer side surface of the fuel tank 14; and a side door 20 for the engine room (i.e. a side door for a cowl) hingedly fixed to an outer side of a cowl frame 19, and extending to a boundary part between the hydraulic fluid tank 13 and the fuel tank 14 to form outer side surfaces of the engine room 4 and the hydraulic fluid tank 13.

The excavator according to another embodiment of the present invention further includes storage parts (not illustrated) corresponding to a space between the outer side surface of the fuel tank 14 and an inner side surface of the side door 16 and a space between the outer side surface of the hydraulic fluid tank 13 and the inner side surface of the side door 16 for the engine room, respectively, to keep service components of the excavator (e.g. a fuel pump for feeding fuel) in custody.

In this case, the construction, except for the side door 16 hingedly fixed to an outer side of the fuel tank 14 and the side door 20 for the engine room hingedly fixed to the cowl frame 19, is substantially the same as that according to the previous embodiment of the present invention, and thus the detailed description thereof will be omitted. The same reference numerals are used for the same elements across various figures.

As described above, the excavator mounted with tanks having side doors according to the embodiments of the present invention has the following advantages.

Since the bend-formed side doors mounted on the outer sides of the tanks have the same curved surfaces as the external shape of the equipment, a mold for precisely manufacturing the tanks is not required, and thus the manufacturing cost is reduced to heighten the price competitiveness of the equipment.

Also, in the case of mounting the tanks that are welded structures, on the upper frame, the deformed welded portions of the tanks, the potbellied side parts of the tanks, and the lower mount portions formed on the bottom surfaces of the tanks can be hidden by the side doors and thus the external appearance of the equipment can be improved.

Although preferred embodiments of the present invention have been described for illustrative purposes, those skilled in the art will appreciate that various modifications, additions and substitutions are possible, without departing from the scope and spirit of the invention as disclosed in the accompanying claims.

What is claimed is:

1. An excavator mounted with tanks having side doors, comprising:

a lower driving structure;

an upper frame mounted on the lower driving structure to be swiveled;

a cap mounted in a front of the upper frame;

an engine room mounted in a rear of the upper frame;

working devices fixed to the upper frame, and composed of a boom, an arm, and a bucket driven by hydraulic cylinders, respectively;

a counter weight mounted in the rear of the upper frame to keep the balance of the excavator during work;

a hydraulic fluid tank and a fuel tank mounted on the upper frame in front of the engine room;

side doors being bend-formed and being hingedly fixed to outer sides of the hydraulic fluid tank and the fuel tank, respectively, to form outer side surfaces of the hydraulic fluid tank and the fuel tank; and storage parts corresponding to spaces between outer side surfaces of the hydraulic fluid tank and the fuel tank and inner side surfaces of the side doors, respectively, to keep service components of the excavator in custody.

2. An excavator mounted with tanks having side doors, comprising:

a lower driving structure;

an upper frame mounted on the lower driving structure to be swiveled;

a cap mounted in a front of the upper frame;

an engine room mounted in a rear of the upper frame;

working devices fixed to the upper frame, and composed of a boom, an arm, and a bucket driven by hydraulic cylinders, respectively;

a counter weight mounted in the rear of the upper frame to keep the balance of the excavator during work;

a hydraulic fluid tank and a fuel tank mounted on the upper frame in front of the engine room;

a side door being bend-formed and being hingedly fixed to an outer side of the fuel tank to form an outer side surface of the fuel tank;

a side door for the engine room being bend-formed and being hingedly fixed to an outer side of a cowl frame, and extending to a boundary part between the hydraulic fluid tank and the fuel tank to form outer side surfaces of the engine room and the hydraulic fluid tank; and storage parts corresponding to a space between the outer side surface of the fuel tank and an inner side surface of the side door and a space between the outer side surface of the hydraulic fluid tank and the inner side surface of the side door for the engine room, respectively, to keep service components of the excavator in custody.

* * * * *